United States Patent [19]

Hall

[11] Patent Number: 4,615,290

[45] Date of Patent: Oct. 7, 1986

[54] MARINE PROPULSION STEERING ASSIST DEVICE

[75] Inventor: Charles B. Hall, Ingleside, Ill.

[73] Assignee: Outboard Marine Corporation, Waukegan, Ill.

[21] Appl. No.: 484,900

[22] Filed: Apr. 14, 1983

Related U.S. Application Data

[63] Continuation-in-part of Ser. No. 451,438, Dec. 20, 1982, Pat. No. 4,509,924.

[51] Int. Cl.[4] ..... B63H 25/22

[52] U.S. Cl. ..... 114/150; 440/61; 440/51

[58] Field of Search ..... 440/51, 53, 55, 61, 440/62, 63, 66; 114/144 R, 146, 150, 162, 167; 74/480 R, 480 B; 244/76 A, 82, 226; 91/59, 509, 510; 92/134

[56] References Cited

U.S. PATENT DOCUMENTS

| | | | |
|---|---|---|---|
| 2,794,609 | 6/1957 | Perry | 244/226 |
| 2,993,464 | 7/1961 | Conover | 440/51 |
| 3,943,878 | 3/1976 | Kirkwood et al. | 114/144 R |
| 4,318,701 | 3/1982 | Kirkwood et al. | 440/51 |
| 4,323,353 | 4/1982 | Kirkwood | 440/63 |
| 4,342,275 | 8/1982 | Brix et al. | 114/150 |
| 4,349,341 | 9/1982 | Morgan et al. | 440/51 |
| 4,352,666 | 10/1982 | McGowan | 440/53 |
| 4,362,515 | 12/1982 | Ginnow | 440/62 |
| 4,373,920 | 2/1983 | Hall et al. | 440/61 |

OTHER PUBLICATIONS

Brochure "Tru-Trim" Steering Inc.
Brochure "Mercury Outboards".

*Primary Examiner*—Trygve M. Blix
*Assistant Examiner*—Jesûs D. Sotelo
*Attorney, Agent, or Firm*—Michael, Best & Friedrich

[57] ABSTRACT

A marine propulsion device comprising a propulsion unit pivotable about a first steering axis to steer a marine vehicle, a trim tab mounted on the propulsion unit and pivotable about a second steering axis for assisting in steering the vehicle, and a hydraulic sensing arrangement for sensing torque on the propulsion unit relative to the first steering axis to pivot the trim tab in response to the torque.

21 Claims, 7 Drawing Figures

MARINE PROPULSION STEERING ASSIST DEVICE

RELATED APPLICATION

This application is a continuation-in-part of a U.S. patent application by Hall filed on Dec. 20, 1982 as Ser. No. 451,438, now U.S. Pat. No. 4,509,924.

BACKGROUND OF THE INVENTION

This invention relates to marine propulsion devices and, more particularly, to means for linking a movable trim tab or skeg foil to a propulsion unit of a marine propulsion device so that the trim tab or skeg foil responds to torque felt by the propulsion unit.

Attention is directed to McGowan U.S. Pat. No. 4,352,666 issued Oct. 5, 1982 which discloses means for linking the movement of a movable trim tab to the torque on a propulsion unit. The McGowan patent is directed to mechanical means responsive to the movement of a swivel bracket relative to a transom bracket, as opposed to hydraulic means for sensing torque on the propulsion unit.

Attention is also directed to Kirkwood U.S. Pat. No. 4,323,353, Kirkwood et al U.S. Pat. Nos. 3,943,878 and 4,318,701, Morgan et al U.S. Pat. No. 4,349,341 and Ginnow U.S. Pat. No. 4,362,515 which disclose steering devices including mechanical mechanisms which rotate a trim tab.

SUMMARY OF THE INVENTION

The invention provides a marine propulsion device comprising a propulsion unit pivotable about a first steering axis to steer a marine vehicle, fin means mounted on the propulsion unit and pivotable about a second steering axis for assisting in steering the vehicle, and hydraulic sensing means for sensing torque on the propulsion unit relative to the first steering axis so as to facilitate pivoting of the fin means in response to the torque.

The invention also provides a marine propulsion device for use with a marine vehicle, which device comprises a propulsion unit pivotal about a first steering axis to steer the vehicle, fin means mounted on the propulsion unit and pivotal about a second steering axis for assisting in steering the vehicle, and means for hydraulically sensing operator applied torque on the propulsion unit relative to the first steering axis and for pivoting the fin means in response to torque sensing of the operator applied torque and for hydraulically sensing hydrodynamically applied torque on the propulsion unit relative to the first steering axis and for pivoting the fin means in response to torque sensing of the hydrodynamically applied torque immediately upon initial steering movement of the propulsion unit.

In one embodiment, the device includes steering means for pivoting the propulsion unit about the first steering axis to steer the vehicle.

In one embodiment, the steering means includes the hydraulic sensing means, and the hydraulic sensing means is responsive to hydrodynamic torque on the propulsion unit relative to the first steering axis and steering torque on the propulsion unit relative to the first steering axis caused by the steering means.

In one embodiment, the device further includes means for pivoting the fin means about the second steering axis and means for operably connecting the hydraulic sensing means to the means for pivoting the fin means.

In one embodiment, the steering means includes a steering member connected to the propulsion unit, and means for moving the steering member to pivot the propulsion unit. In this embodiment, the means for moving the steering member includes a linking member and a receiving member pivotally connected to the steering member. In this embodiment, the hydraulic sensing means comprises a hydraulic cylinder on the receiving member and a piston connected to the linking member and received in the hydraulic cylinder. The hydraulic sensing means permits lost motion between the piston and the receiving member and uses this motion to sense torque on the propulsion unit relative to the first steering axis.

In another embodiment, the means for moving the steering member to pivot the propulsion unit comprises elongated support means, a hydraulic cylinder movable on the support means, means for connecting the steering member to the hydraulic cylinder and means for selectively displacing the hydraulic in the direction of the length of the support means. In this embodiment, the hydraulic sensing means comprises the hydraulic cylinder and a piston received in the hydraulic cylinder and forming a part of the elongated support means.

In one embodiment, the marine propulsion device further includes a propeller and means for reversing the direction of movement of the fin means by the pivoting means. The reversing means can operate in response to changes in propeller wash pressure, or the reversing means can operate in response to operation of shifting means for changing the rotation of the propeller.

In one embodiment, the shifting means includes a solenoid actuated when the rotation of the propeller is changed.

In one embodiment, the reversing means comprises valve means and means for operating the valve means. The valve means comprises a valve housing including an elongated cylindrical chamber, a first inlet port, a second inlet port spaced apart from the first inlet port, a first outlet port spaced outside of the first and second inlet ports and adjacent the first inlet port, a second outlet port spaced outside of the first and second inlet ports and adjacent the second inlet port, and a third outlet port spaced between the first and second inlet ports.

The valve means also includes means defining two movable smaller chambers in the elongated cylindrical chamber and comprising three aligned, spaced apart solid cylindrical portions, a first smaller diameter connecting rod connecting the first portion to the second portion, and a second smaller diameter connecting rod connecting the second portion to the third portion.

The means defining the two movable smaller chambers is movable between a first position wherein the first inlet port is in communication with the third outlet port and the second inlet port is in communication with the second outlet port, and a second position wherein the first inlet port is in communication with the first outlet port and the second inlet port is in communication with the third outlet port.

The invention also provides a marine propulsion device comprising a plurality of propulsion units pivotable about first parallel steering axes to steer a marine vehicle, fin means mounted on the propulsion units pivotable about parallel second steering axes for assisting in steering the vehicle, and hydraulic sensing means for sensing torque on the propulsion units relative to the first steering axes to pivot the fin means in response to the torque.

Figure 2:
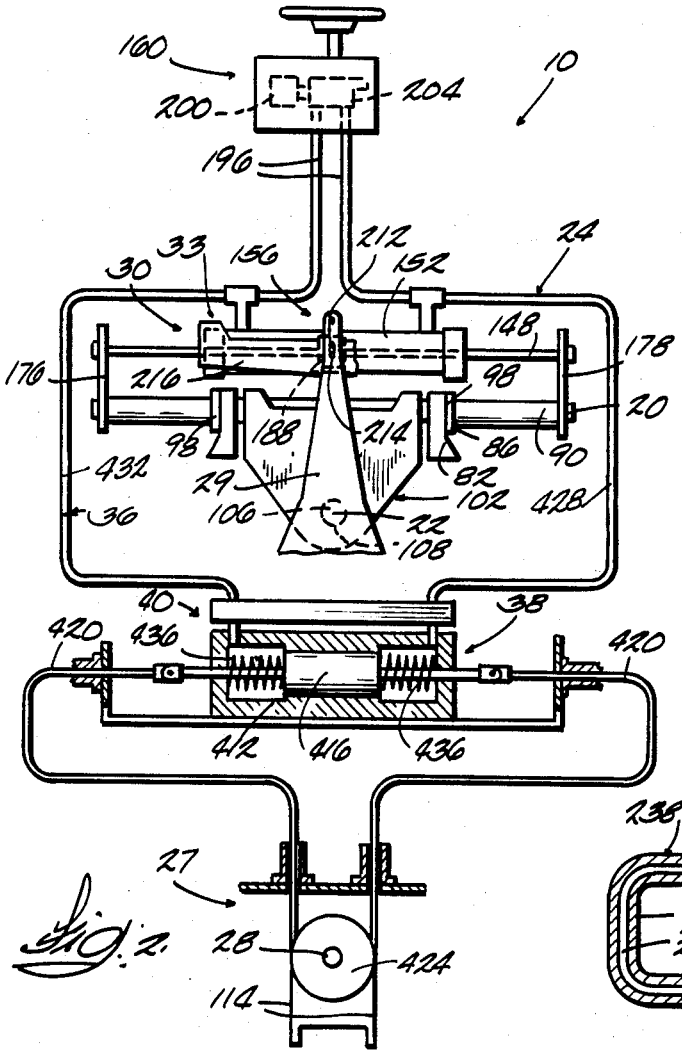
FIG. 2 is a schematic representation of a first embodiment of a marine propulsion device including various features of the invention.

Before explaining at least one embodiment of the invention in detail, it is to be understood that the invention is not limited in this application to the details of construction and the arrangements of components set forth in the following description or illustrated in the drawings. The invention is capable of other embodiments and of being practiced or carried out in various ways. Also, it is to be understood that the phraseology and terminology employed herein is for the purpose of this description and should not be regarded as limiting.

DESCRIPTION OF PREFERRED EMBODIMENTS

As illustrated in the drawings, the invention provides a marine propulsion device 10 including a marine propulsion unit 12 in the form of an outboard motor. In other construction, the propulsion unit 12 can be in the form of a stern drive (not shown). The marine propulsion device 10 also includes means 14 for supporting the propulsion unit from a transom 16 of a marine vehicle 18 for vertical tilting movement of the propulsion unit 12 about a horizontal tilt axis 20 and horizontal steering movement of the propulsion unit 12 about a vertical steering axis 22.

The marine propulsion device 10 also includes three embodiments 24, 25 and 26 (shown respectively in FIGS. 2, 3 and 4) of steering means for pivoting the propulsion unit 12 about the first steering axis 22 to effect steering of the marine vehicle 18 and fin means 27 mounted on the propulsion unit 12 and pivotable about a second vertical steering axis 28 for assisting in steering the marine vehicle 18. The steering means includes a steering member or arm 29 and three embodiments 30, 31, and 32 (shown respectively in FIGS. 2, 3 and 4) of means for moving the steering arm 29 to pivot the propulsion unit 12 to effect steering of the marine vehicle 18.

The marine propulsion device 10 also includes three embodiments 33, 34, and 35 (shown respectively in FIGS. 2, 3 and 4) of hydraulic sensing means for sensing torque on the propulsion unit 12 relative to the first steering axis 22 to pivot the fin means 27 in response to the torque. The three embodiments of the hydraulic sensing means are described in conjunction with the three arrangements of the steering means.

The marine propulsion device 10 also includes means 36 for operably connecting the hydraulic sensing means to means 38 for pivoting the fin means 27 and means 40 for reversing the direction of movement of the fin means 27 in response to operation by the hydraulic sensing means.

Figure 1:
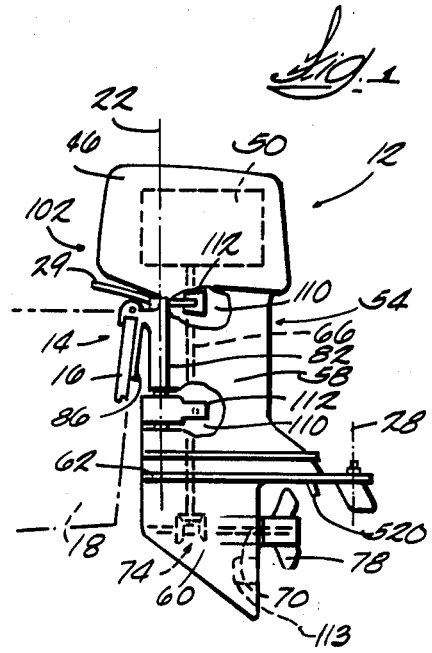
FIG. 1 is a side view of a marine propulsion device including a marine propulsion unit.

More particularly, the propulsion unit 12 shown in FIG. 1 includes a power head 46 including an internal combustion engine 50 which is carried on a lower unit 54 having a drive shaft housing 58 rigidly supporting the internal combustion engine 50 and a gear case 60 rigidly attached to the bottom of the drive shaft housing 58. The lower unit 54 of the propulsion unit 12 also includes an anti-ventilation 62 located approximately at the connection of the drive shaft housing 58 to the gear case 60.

Rotatably supported in the drive shaft housing 58 is a vertically disposed drive shaft 66 which is drivenly connected to the engine 50 and also drivingly connected to a propeller shaft 70 through a reversing transmission 74 to drive a propeller 78 carried on the aft end of the propeller shaft 70.

While various arrangements can be employed for the means 14 for supporting the propulsion unit 12 from the transom 16, in the illustrated construction, such means 14 comprises a swivel bracket 82 pivotally connected to a transom bracket 86 adapted to be fixed to the transom 16 of the marine vehicle 18. Vertical tilting of the swivel bracket 82 relative to the transom bracket 86 about the transverse or horizontal tilt axis 20 is provided by a tilt tube 90 including opposite ends extending through aligned apertures 98 in the transom bracket 86 and swivel bracket 82, as illustrated in FIG. 2.

Pivotal movement of the propulsion unit 12 relative to the transom bracket 86 and swivel bracket 82 about the first steering axis 22 is provided by means 102 for pivotally connecting the propulsion unit 12 to the swivel bracket 82. This means 102 includes a kingpin 106 which extends through a vertical bore 108 in the swivel bracket 82. The upper and lower ends of the king pin include means 110 for mounting the propulsion unit 12 on the kingpin 106 in the form, in part, of brackets 112. A more detailed description of one such means 110 for mounting the propulsion unit 12 on the kingpin 106 is described in Hall U.S. Pat. No. 3,934,537, which is incorporated herein by reference.

The fin means 27 is carried by the anti-ventilation plate 62 and is movable between a normal running or neutral steering position and maximum counterbalancing positions clockwise and counterclockwise from the neutral steering position. The fin means 27 is offset toward the rear of the propulsion unit 12 a greater distance from the center of lateral resistance of the gear case 60 than the first steering axis 22. Thus less force is required to pivot the propulsion unit 12 with the fin means 27 than is necessary to pivot the propulsion unit 12 through the steering means. Accordingly, the fin means 27 greatly assists in steering the marine vehicle 18.

Figure 6:
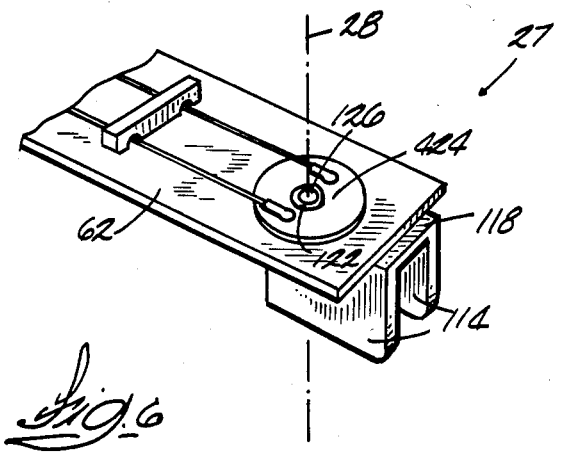
FIG. 6 is a perspective view of a portion of the propulsion device including a trim tab.

In the embodiment illustrated, the fin means 27 comprises a trim tab, although a skeg foil 113 or other steering assisting or torque correcting device can be used in other embodiments. The trim tab 27, in the construction more particularly illustrated in FIG. 6, includes two trim tab elements or fins 114 which can be of any suitable shape and which, at their upper ends, extend fixedly from a common horizontally extending member 118. If desired, the trim tab 27 can employ only a single trim tab element or fin or more than two trim tab elements. Extending upwardly from a forward section of the horizontal member 118, and through a bearing or bushing 122 carried by the anti-ventilation plate 62, as best shown in FIG. 6, is a stud 126 which provides for pivotal movement of the trim tab 27 about the generally vertical second steering axis 28. Any suitable means can be employed to retain the stud 126 in the bearing 122 carried by the anti-ventilation plate 62.

One embodiment 33 of the hydraulic sensing means for sensing torque on the propulsion unit 12 relative to the first steering axis 22, and the first steering means 24 for pivoting the propulsion unit 12 about the first steering axis 22 to steer the vehicle 18 is illustrated in FIG. 2. The first steering means is also disclosed in Hall et al U.S. Pat. No. 4,373,920 issued on Feb. 15, 1983, which is incorporated herein by reference.

The steering means 24 includes the steering arm 29 which extends rigidly from the top of the kingpin 106 in a forward direction and means 30 for moving the steering arm 29 to effect pivoting of the propulsion unit 12 to steer the vehicle 18. The moving means 30 comprises elongated support means 148, a member 152 movable on the support means 148, and means 156 for connecting the steering arm 29 to the member 152 movable on the support means 148. Operator activating means 160 is also provided for selectively displacing the member 152 in the direction of the length of the support means 148.

More particularly, the elongated support means 48 is fixed against axial movement relative to the transom bracket 86 and is tiltable relative to the transom bracket 86 to provide common tilting with the swivel bracket 82. The support means 148 also extends in parallel, preferably forward relationship to the tilt axis 20 and comprises an elongated support rod which, at its opposite ends, is fixedly supported by arms 176 and 178 which extend rigidly and radially from opposite ends of the tilt tube 90. The tilt tube 90 is suitably fixed against axial movement relative to the swivel bracket 82 and is rotatable relative to the transom bracket 86 so as to permit tilting in common with the swivel bracket 82.

In the illustrated construction, the member 152 movable along the support rod 148 comprises a hydraulic cylinder, and the hydraulic cylinder 152 and a piston 188 comprise the hydraulic sensing means 33. The support rod 148 is provided with the piston 188 which is fixed centrally thereof and which is received in the hydraulic cylinder 152 which includes opposite ends from which the ends of the support rod 148 extend. The hydraulic cylinder 152 is movable relative to the piston 188 and to the support rod 148 in response to selective application thereto of hydraulic fluid from the operator actuating means 160 through hydraulic conduits 196 connected to the cylinder 152 adjacent the opposite ends thereof. The operator activating means 160 includes a suitable source of pressure hydraulic fluid 200 and a suitable valving arrangement 204 for selectively applying hydraulic fluid pressure to one cylinder end and draining hydraulic fluid from the other cylinder end. As is apparent, the pressure fluid source 200 and the valving arrangement 204 can be located remotely from the propulsion unit 12, as illustrated in FIG. 2.

Means 156 provided for connecting the steering arm 29 to the hydraulic cylinder 152 comprises a stud 212 extending fixedly from the steering arm 29 and received in a slot 214 which is provided in a bracket 216 attached to the hydraulic cylinder 152. The stud 212 extends perpendicularly to the direction of travel of the hydraulic cylinder 152, i.e., perpendicular to the tilt axis 20, and any suitable means can be employed to prevent removal or disconnection of the stud 212 from the slot 214.

The first embodiment 33 of the hydraulic sensing means, as do the other embodiments 34 and 35 of the hydraulic sensing means, operates in response to steering torque initiated by a marine vehicle operator through the operator actuating means 160 and hydrodynamic torque on the propulsion unit 12 caused by forces exterior to the propulsion device 10. The hydrodynamic torque results from lateral thrust on the propulsion unit 12 caused by movement of the propulsion unit 12 through water at an angle and propeller side loads resulting from variations in water density, water surface turbulence and propeller shaft running at an angle to direction of motion.

The operator of the marine vehicle can steer the vehicle by the operator actuating means 160. The operator actuating means 160 adds hydraulic fluid to one end of the hydraulic cylinder 152 and drains hydraulic fluid from the other end of the hydraulic cylinder 152. The resultant fluid pressure differential serves to move the hydraulic cylinder 152 relative to the support rod 148 and pivot the propulsion unit 12. The pressure differential also operates through the means 36 for operably connecting the hydraulic sensing means 33 to the means 38 for pivoting the trim tab 27 to transmit some of the fluid from the operator actuating means 160 to the means 38 for pivoting the trim tab so that the trim tab 27 is pivoted to assist in steering the vehicle 18.

Hydrodynamic loads on the propulsion unit 12 pivot the propulsion unit 12 and, consequently, the steering arm 29 fixed to the propulsion unit 12 moves the hydraulic cylinder 152 relative to the support rod 148 and displaces fluid to adjust the trim tab 27. As the propulsion unit 12 then returns to the position assumed prior to being displaced by the hydrodynamic loads, the hydraulic cylinder 152 returns to its prior position and the trim tab 27 returns to its position prior to the hydrodynamic loads.

Figure 3:
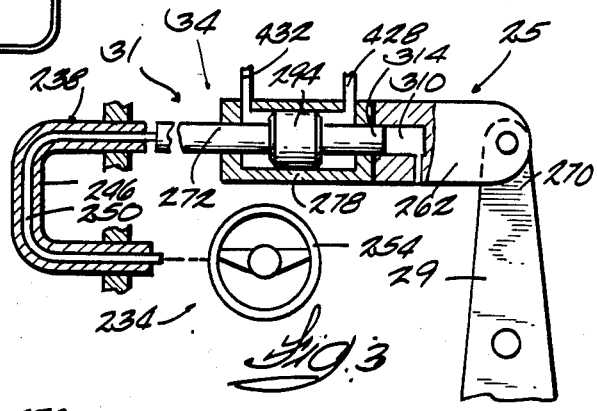
FIG. 3 is a schematic representation of a second embodiment of a marine propulsion device including various features of the invention.

The second embodiment 34 of the hydraulic sensing means for sensing torque on the propulsion unit 12 relative to the first steering axis 22 is illustrated in FIG. 3, in conjunction with the second arrangement 25 for the steering means. In this embodiment, the steering means 25 includes the steering arm 29 and means 31 for moving the steering arm 29 to pivot the propulsion unit 12.

The moving means 31 is operably connected to operator actuating means 234. The operator actuating means 234 comprises a push-pull cable 238 including a flexible housing 246 and a core 250 movable axially by a steering wheel 254 or some other means for moving the flexible core 250. The flexible housing 246 is fixedly mounted to prevent lateral movement of the housing 246.

The means 31 for moving the steering arm 29 is connected between the core 250 and the steering arm 29 and causes movement of the steering arm 29. More particularly, the means 31 for moving the steering arm 29 comprises a receiving member 262 pivotally connected to the end 270 of the steering arm 29, a link arm 272 connected to the core 250 of the push-pull cable 238, and means 34 connecting the core 250 to the receiving member 262 and permitting limited lost motion of the link arm 272 relative to the receiving member 262. The means 34 permitting limited lost motion of the link arm 272 relative to the receiving member 262 is also the hydraulic sensing means 34 in this embodiment.

The hydraulic sensing means 34 comprises a hydraulic cylinder 278 which is incorporated in an end of the receiving member 262 opposite the end thereof pivotally connected to the end 270 of the steering arm 29. Slidably received in the cylinder 278 is a piston 294 fixed on the link arm 272. A vented bore 310 in the receiving member 262 is also provided adjacent the end of hydraulic cylinder 278 adjacent the steering arm 34 to receive the free end 314 of the link arm 272 when the piston 294 moves relative to the receiving member 262.

The hydraulic sensing means 34 is responsive to steering torque on the propulsion unit 12 and operates in the following manner. As the link arm 272 is moved by the core 250 of the push-pull cable 238, the link arm 272 and the piston 294 move relative to the receiving member 262 and the steering arm 29. This relative movement results in the displacement of hydraulic fluid in the hydraulic cylinder 278 which is then used to rotate the trim tab 27. After the piston 294 abuts the hydraulic cylinder 278, the link arm 272 moves the receiving member 262 and the steering arm 29 in order to pivot the propulsion unit 12.

The hydraulic sensing means 34 is also responsive to hydrodynamic torque on the propulsion unit 12 and operates in the following manner. When the steering arm 29 is rotated by torque on the propulsion unit 12 exterior to the propulsion device 10, and the link arm 272 and piston 294 are stationary, hydraulic fluid is displaced by the piston 294 moving relative to the hydraulic cylinder 278 and the displaced fluid causes the trim tab 27 to be adjusted to counteract the torque on the propulsion unit 12.

Figure 4:
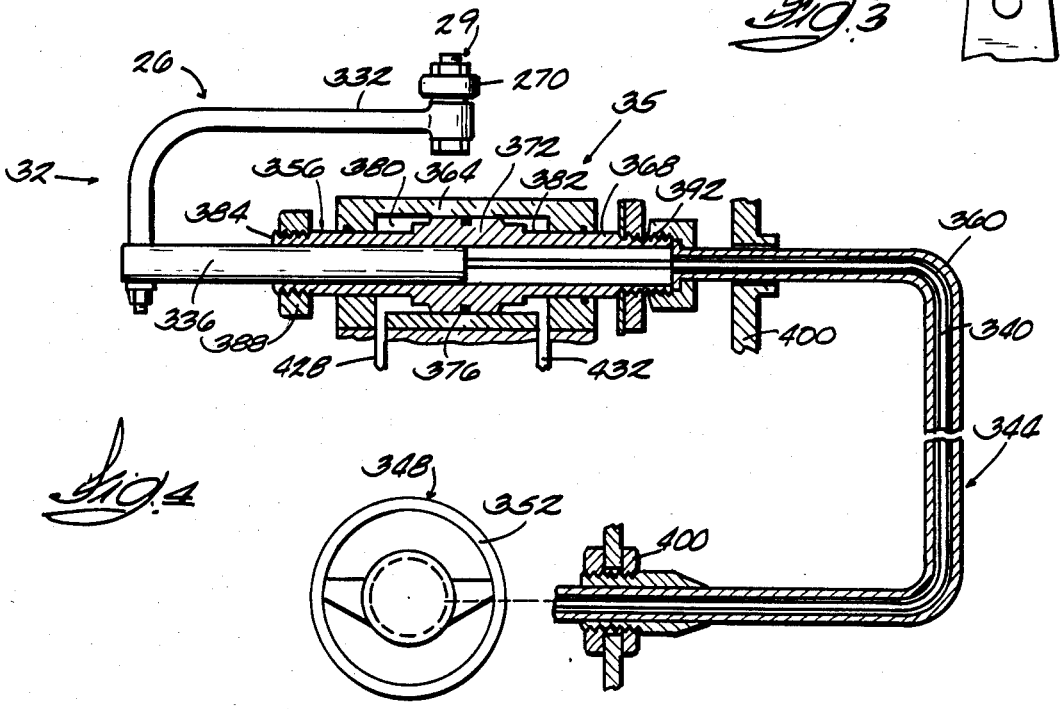
FIG. 4 is a schematic representation of a third embodiment of a marine propulsion device including various features of the invention.

The third embodiment 35 of hydraulic sensing means for sensing torque on the propulsion unit 12 relative to the first steering axis 22 is illustrated in FIG. 4 in conjunction with the third arrangement 26 of the steering means. In this embodiment, the steering means 26 includes the steering arm 29 and means 32 for moving the steering arm 29 to pivot the propulsion unit 12. The moving means 32 includes a connecting arm 332 pivotally connected to the end 270 of the steering arm 29 and a cable ram 336 fixedly connected to the connecting arm 332. The moving means 32 also includes a core 340 of a push-pull cable 344 which is attached to the cable ram 336. The core 340 is also connected to operator activating means 348 including a steering wheel 352 or other means for axially moving the core 340.

The hydraulic sensing means 35 comprises a piston 356, a flexible housing or outer sheath 360 of the push-pull cable 344 connected to the piston 356 and a hydraulic cylinder 364 which slidably receives the piston 356. The hydraulic sensing means 35, in addition to sensing torque on the propulsion unit 12 relative to the first steering axis 22, also permits limited lost motion between the piston 356 and the steering arm 29 and the lost motion is used to adjust the trim tab 27, as hereinafter described.

More particularly, the piston 356 comprises a sleeve 368 which slidably receives the end of cable ram 336 connected to the core 340, and means 372 for separating the two ends 380 and 382 of the hydraulic cylinder 364. In this embodiment, this means 372 comprises a flange 372 extending radially outwardly from the sleeve 368. The flange 372 includes sealing means 376 to prevent fluid communication between the ends 380 and 382 of the hydraulic cylinder 364. One end 384 of the sleeve 368 extends from the end 380 of the hydraulic cylinder 364 and includes stopping means 388 for limiting the amount of movement of the piston 356 relative to the hydraulic cylinder 364, and the other end 392 of the sleeve 268 extends from the opposite end 382 of the cylinder 364 and is fixedly connected to the flexible housing 360, and likewise includes stopping means for limiting the amount of movement of the piston 356 relative to the hydraulic cylinder 364.

The hydraulic sensing means 35 further includes mounting means 400 for securing the push-pull cable housing 360 so that the push-pull cable housing 360 is fixed near the operator actuating means 348 and is slidable near the hydraulic cylinder 364 so an arc formed by the push-pull cable 344 between the mounting means 400 can be varied.

When the core 340 of the cable 344 is pushed by the operator actuating means 348 towards the cable ram 336, the mounting means 400 for securing the cable housing 360 permits the arc of the cable housing 360 to flatten, thereby causing movement of the cable housing 360 and piston 356 relative to the hydraulic cylinder 364. This movement of the piston 356 causes displacement of hydraulic fluid to pivot the trim tab 27 as the cable core 340 moves the cable ram 336 to pivot the propulsion unit 12. In addition, hydrodynamic torque on the propulsion unit 12 pivots the steering arm 29 to cause the cable ram 336 and cable 344 to move relative to the hydraulic cylinder 364. This displaces the piston 356 and results in displacement of hydraulic fluid to also cause adjustment of the trim tab 27.

The means 38 for pivoting the trim tab 27 comprises a hydraulic cylinder 412 and a double ended piston rod 416. As shown in FIG. 6, the ends of the piston rod 416 are each respectively connected to push-pull cables 420 which, in turn, are respectively connected to opposite sides of a disc 424 extending radially outwardly from the upper end of the stud 126. Movement of the piston rod 416 occurs in response to hydraulic fluid displaced from the hydraulic sensing means 33, 34 or 35 and the movement of the piston rod 416 causes a push-pull type operation through the push-pull cables 420 on the disc 424 to rotate the horizontal member 118 to adjust the trim tab 27.

The hydraulic cylinders 152, 278 and 364 of all embodiments 33, 34 and 35 of the hydraulic sensing means are operably connected by the conduit means 36 to the means 38 for pivoting the trim tab 27, as illustrated, for example, in FIG. 2. The conduit means 36 connects the hydraulic cylinder 152, 278 or 364 of the hydraulic sensing means and the hydraulic cylinder 412 of the trim tab pivoting means 38 so that the trim tab 27 serves to counteract torque on the propulsion unit 12 or assist in steering the marine vehicle 18.

More particularly, the conduit means 36 is connected between the cylinder 152, 278 or 364 and the cylinder 412 so that pivoting of the propulsion unit 12 by hydrodynamic loads on the unit 12 results in pivoting of the trim tab 27 in the same direction as to the direction of pivoting of the propulsion unit 12. Accordingly, the trim tab 27 counteracts the hydrodynamic torque on the propulsion unit 12 and returns the propulsion unit 12 to the position of the propulsion unit 12 prior to being acted upon by the loads.

Likewise, when operator induced steering torques occur on the propulsion unit 12 through the steering means 24, 25 or 26 and in response to movement by the operator actuating means 160, 234 or 348, the conduit, means 36 serves to pivot the trim tab 27 in the opposite direction as the pivoting of the propulsion unit 12.

More particularly, the conduit means 36 includes a first conduit 428 connecting one end of the hydraulic sensing cylinder 152, 278 or 364 to one end of the trim tab adjusting hydraulic cylinder 412 and a second conduit 432 which connects the other end of the hydraulic sensing cylinder 152, 278 or 364 to the other end of the trim tab adjusting hydraulic cylinder 412. The appropriate connections of the conduits 428 and 432 to the appropriate ends of the hydraulic sensing cylinders 152, 278 and 364 is shown in FIGS. 2, 3 and 4.

The parameters affecting the torque correcting or steering assisting capability of the trim tab 27 include the hydraulic cylinder area, the length of the steering arm or other members in the steering means, the trim tab adjusting cylinder area, the distance from the center of the surface area of the trim tabs to the pivot point of the trim tab, the trim tab to unit steering center distance, and the trim tab or foil area. These parameters should be selected so that the counterbalancing torque of the trim tab 27 is less than the initializing torque so that the steering means 24, 25 or 26 has an understeering tendency during forward travel of the marine vehicle.

Alignment of the propulsion unit 12 with the direction of travel of the marine vehicle 18 causes the trim tab 27 to return to the neutral steering position by virtue of the hydraulic sensing and trim tab adjusting means previously described, as well as by having the fins 114 of the trim tab 27 offset rearwardly from the point of pivotal connection of the trim tab 27 to the anti-ventilation plate 62, as shown in FIG. 6.

Additional means 436, however, are provided for biasing the trim tab 27 towards the neutral steering position. Although various means can be employed, in the illustrated construction such means 436 comprises springs disposed in the trim tab adjusting cylinder 412 to bias the piston rod 416 toward a position near the center of the hydraulic cylinder 412 where the trim tab 27 will assume the neutral steering position.

Figure 5:
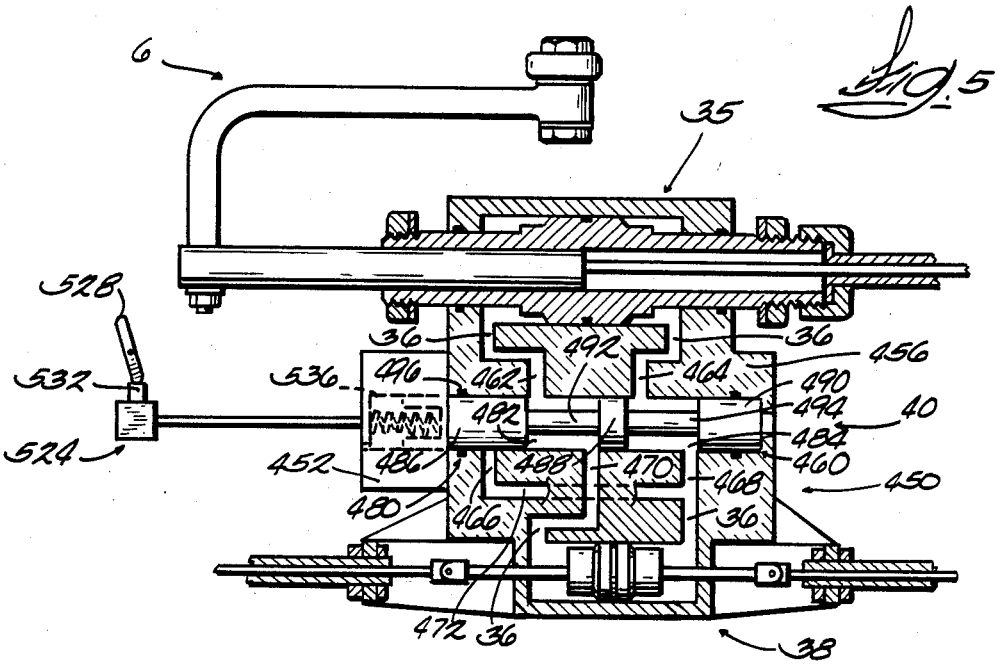
FIG. 5 is a view partially in section of the third embodiment of the marine propulsion device and reversing means including various features of the invention.

As shown in FIG. 5, spliced in the conduit means 36 connecting the hydraulic sensing means 33, 34 or 35 and the means 38 for pivoting the trim tab 27 is the means 40 for reversing the direction of movement of the trim tab 27 in response to operation by the hydraulic sensing means 33, 34 or 35. The reversing means 40 comprises valve means 450 and means 452 for operating the valve means 450 in response to changes in propeller wash pressure or changes in the direction of rotation of the propeller 78.

The valve means 450 comprises a valve housing 456 including an elongated cylindrical chamber 460 and first and second spaced-apart inlet ports 462 and 464 on one side of the chamber 460 and in communication with the hydraulic sensing means 33, 34 or 35. The valve housing 456 also includes three spaced-apart chamber outlet ports 466, 468 and 470 on an opposite side of the chamber 460. The first and second chamber outlet ports 466 and 468 are spaced opposite one another outside of the inlet ports 462 and 464, and the third chamber outlet port 470 is spaced between the inlet ports 462 and 464. The second chamber outlet port 468 is in communication with one side of the trim tab adjusting hydraulic cylinder 412 and in communication with the first chamber outlet port 466 by means of a bore 472 in the housing 456 running parallel to the chamber 460. The third chamber outlet port 470 is in communication with the other side of the trim tab adjusting hydraulic cylinder 412.

The valve means 450 further includes means 480 defining two movable smaller chambers 482 and 484 in the housing chamber 460, and which, in the illustrated construction, comprises a valve member. The valve member 480 includes three spaced apart coaxial solid cylindrical portions 486, 488 and 490 connected to one another by two smaller diameter connecting rods 492 and 494. The valve member 480 is snugly received in the housing chamber 460 and the three spaced-apart cylindrical portions 486, 488 and 490 serve to divide the housing chamber 400 into the two movable smaller chambers 482 and 484, with the intermediate solid cylindrical portion 488 dividing the two chambers 482 and 484. The two outer cylindrical portions 486 and 490 include sealing means 496 for effectively sealing the smaller chambers 482 and 484 from the remainder of the housing chamber 460. The housing chamber 460 is vented at both ends to permit movement of the valve member 480.

The valve member 480 is movable between two positions by the means 452 for operating the valve means. In the first position, the valve member 480 is to the right side of the housing chamber 460, as shown in FIG. 5, and the movable smaller chambers 482 and 484 permit fluid to pass from the inlet ports 462 and 464 to the third and second chamber outlet ports 470 and 468, respectively. In addition, the left cylindrical portion 486 closes the first outlet port 466 and the intermediate cylindrical portion 488 separates the second inlet port 464 from the third outlet port 470.

In the second position, the valve member 480 is to the left side of the housing chamber 460, as shown in FIG. 5, and the movable smaller chambers 482 and 484 permit fluid to pass from the inlet ports 462 and 464 to the first chamber outlet port 466 and the third chamber outlet port 470, respectively. More particularly, the right cylindrical portion 490 closes the second outlet portion 468 and the intermediate cylindrical portion 488 separates the first inlet port 462 from the third chamber outlet port 470. The valve member 480 thus serves to reverse the fluid connection between the hydraulic sensing means and the means 38 for pivoting the trim tab 28.

As illustrated in FIG. 5, the valve housing 456 also includes the hydraulic sensing means 320 and the means 38 for pivoting the trim tab 27, although in other arrangements, the hydraulic sensing means 33, 34 or 35 and means 38 for pivoting the trim tab 27 can be enclosed in separate housings and connected to the valve housing 456 by the conduit means 36, as illustrated for example, schematically in FIG. 2.

Various arrangements can be employed for the means 452 for operating the valve means 450 in response to changes in propeller wash pressure or changes in the direction of the rotating propeller 78.

One such arrangement includes, as illustrated in FIG. 1, a pitot tube 520 disposed in the propeller wash behind the propeller 78. The pitot tube 520 is operably connected to one end of the valve member 480 by means (not shown) to move the valve member 480 from one position to another in response to changes in propeller wash pressure.

In another arrangement, the valve member 480 is operably connected to means 524 for shifting the direction of the rotation of the propeller 78. Although various means of providing such an operable connection are possible, one constuction could include mechanical linkage (not shown) to move the valve member 480 from the one position to another as the shifting means 524 is moved from a forward to reverse position, for example.

In a third arrangement, the shifting means 524 includes a shift lever 528 which is operably connected to an electrical switch 532. The electrical switch 532 is operably connected to a solenoid 536 attached to one end of the movable valve member 480. As the shift lever 528 is moved from a forward to reverse position, for example, the switch 532 closes and activates the solenoid 536 in order to move the valve member 480 from one position to another. And in a fourth arrangement, an electrical switch (not shown) can be provided between the brackets 112 of the means 110 for mounting the propulsion unit 12 on the king pin 106 and the drive shaft housing 58 to detect movement of the propulsion unit 12 relative to the brackets 112 when the marine vehicle 18 changes direction.

Figure 7:
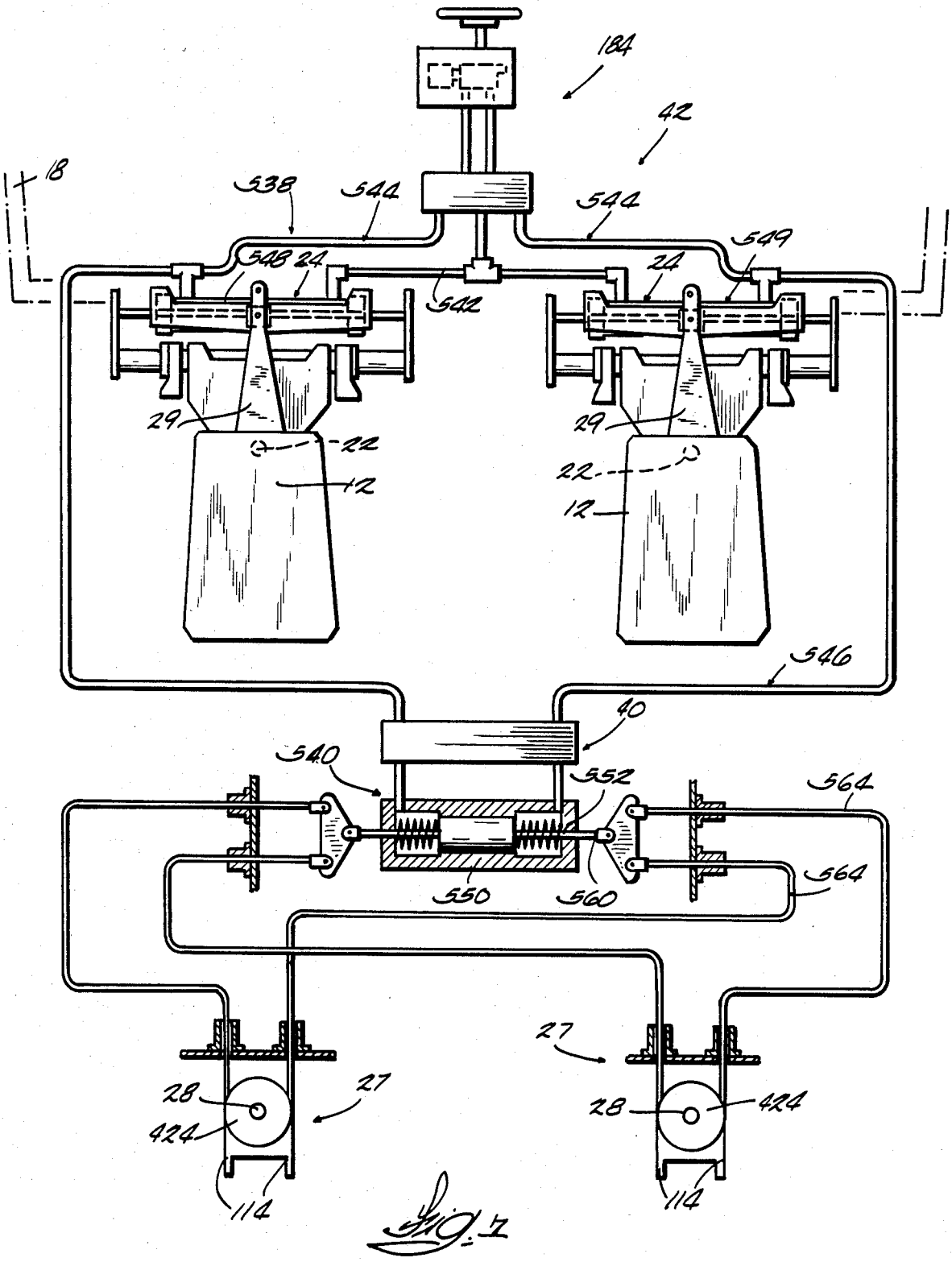
FIG. 7 is a schematic view of another embodiment of a marine propulsion device including various features of the invention.

In another embodiment of the invention, as illustrated in FIG. 7, a marine propulsion device 42 includes a plurality of propulsion units 12. Each propulsion unit 12 has associated means 14 for supporting the propulsion unit from the transom 16 of the marine vehicle 18, hydraulic sensing means 33, steering means 24 for pivoting the propulsion unit 12 about parallel first steering axes 22, and fin means 27, all as previously described. The first embodiments of the hydraulic sensing means 33 and steering means 24 are disclosed and illustrated in FIG. 7, although the other embodiments 34, 35 and 25, 26, respectively, can be used.

The marine propulsion device 42 also includes means 538 for connecting the hydraulic sensing means 33 to trim tab pivoting means 540. The connecting means 538 include conduits 542 which connect hydraulic cylinders 548 and 549 of the hydraulic sensing means 33 in series and conduits 544 which connect the cylinders 548 and 549 to the operator actuating means 184. A more particularized description of the propulsion unit connection arrangement is contained in a copending application filed by Charles B. Hall as Ser. No. 258,874 on Apr. 29, 1981 and which is incorporated herein by reference.

The connecting means 538 also includes conduit means 546 which connects the first hydraulic cylinder 548 and the last hydraulic cylinder 549 to the means 540 for pivoting the trim tabs 27, as illustrated in FIG. 7.

In this embodiment, the means 540 for pivoting the trim tabs 27 in response to operation by the hydraulic sensing means 33 comprises a hydraulic cylinder 550 and a double-ended piston rod 552. Each end 560 of the piston rod 552 is connected to a plurality of push-pull cables 564 which in turn are connected to a similar side of each of the trim tab discs 424. Movement of the piston rod 552 causes a push-pull type operation through the push-pull cables 564 to cause similar adjustment of each of the trim tabs 27.

Spliced in the conduit means 546 connecting the trim tab adjusting cylinder 550 to the first and last hydraulic cylinders 548 and 549 is the means 40 for reversing the direction of movement of the trim tabs 27 in response to operation by the hydraulic sensing means 33.

Various of the features of the invention are set forth in the following claims.

I claim:

1. A marine propulsion device for use with a marine vehicle, said device comprising a propulsion unit pivotable about a first steering axis to steer the vehicle, fin means mounted on said propulsion unit and pivotable about a second steering axis for assisting in steering the vehicle, and means for hydraulically sensing operator applied torque on said propulsion unit relative to said first steering axis and for pivoting said fin means in response to torque sensing of said operator applied torque and for hydraulically sensing hydro-dynamically applied torque on said propulsion unit relative to said first steering axis and for pivoting said fin means in response to torque sensing of said hydrodynamically applied torque immediately upon initial steering movement of said propulsion unit.

2. A marine propulsion device in accordance with claim 1 and further including steering means for pivoting said propulsion unit about said first steering axis to steer the vehicle.

3. A marine propulsion device in accordance with claim 2 wherein said steering means includes said hydraulic sensing means and wherein said device further includes means for pivoting said fin means about said second steering axis and means for operably connecting said hydraulic sensing means to said means for pivoting said fin means.

4. A marine propulsion device in accordance with claim 3 wherein said steering means includes a steering member connected to said propulsion unit, and means for moving said steering member to pivot said propulsion unit.

5. A marine propulsion device in accordance with claim 4 wherein said means for moving said steering member includes a linking member, and wherein said hydraulic sensing means permits lost motion between said linking member and said steering member, and wherein said hydraulic sensing means senses torque on the propulsion unit relative to the first steering axis by movement of said linking member relative to said steering member.

6. A marine propulsion device in accordance with claim 5 wherein said means for moving said steering member further includes a receiving member pivotally connected to said steering member, and wherein said hydraulic sensing means comprises a hydraulic cylinder on said receiving member and a piston connected to said linking member and received in said hydraulic cylinder.

7. A marine propulsion device in accordance with claim 1 wherein said pivoting means includes a piston rod in a hydraulic cylinder, and wherein said biasing means includes springs in said cylinder, said springs biasing said piston rod towards a position near the center of said hydraulic cylinder.

8. A marine propulsion device in accordance with claim 4 wherein said means for moving said steering member to pivot said propulsion unit comprises elongated support means, a traveling member movable on the support means, and means for connecting the steering member to the traveling member movable on the support means.

9. A marine propulsion device in accordance with claim 1 wherein said traveling member comprises a hydraulic cylinder and wherein said elongated support means includes a piston received in said hydraulic cylinder, and wherein said hydraulic sensing means comprises said piston and said hydraulic cylinder.

10. A marine propulsion device in accordance with claim 3 wherein said fin pivoting means includes biasing means for biasing said fin means towards a neutral steering position.

11. A marine propulsion device in accordance with claim 1 wherein said second steering axis is parallel to said first steering axis.

12. A marine propulsion device in accordance with claim 1 wherein said fin means comprises a trim tab.

13. A marine propulsion device in accordance with claim 1 wherein said fin means comprises a skeg foil.

14. A marine propulsion device for use with a marine vehicle, said device comprising a propulsion unit pivotable about a first steering axis to steer the vehicle, fin means mounted on said propulsion unit and pivotable about a second steering axis for assisting in steering the vehicle, hydraulic sensing means for sensing torque on said propulsion unit relative to said first steering axis so as to facilitate pivoting of said fin means in response to said torque, means for pivoting said fin means about said second steering axis, and means operably connecting said hydraulic sensing means to said fin pivoting means for pivoting said fin means in response to the application of torque to said propulsion unit, said connecting means including means for selectively reversing the direction of fin means movement independently of variation in the application of torque to said propulsion unit.

15. A marine propulsion device for use with a marine vehicle, said device comprising a propulsion unit pivotable about a first steering axis to steer the vehicle, a rotating propeller, shifting means for changing the direction of rotation of said propeller, fin means mounted on said propulsion unit and pivotable about a second steering axis for assisting in steering the vehicle, hydraulic sensing means for sensing torque on said propulsion unit relative to said first steering axis so as to facilitate pivoting of said fin means in response to said torque, means for pivoting said fin means about said second steering axis, and means operably connecting said hydraulic sensing means to said means for pivoting said fin means, said connecting means including means for reversing the direction of movement of said fin means by said fin pivoting means, said reversing means reversing the direction of rotation of said fin means in response to operation of said shifting means.

16. A marine propulsion device in accordance with claim 15 wherein said shifting means includes a solenoid actuated when the rotation of said propeller is changed and wherein said reversing means is operated by said solenoid.

17. A marine propulsion device for use with a marine vehicle, said device comprising a propulsion unit pivotable about a first steering axis to steer the vehicle, fin means mounted on said propulsion unit and pivotable about a second steering axis for assisting in steering the vehicle, hydraulic sensing means for sensing torque on said propulsion unit relative to said first steering axis so as to facilitate pivoting of said fin means in response to said torque, means for pivoting said fin means about said second steering axis and means operably connecting said hydraulic sensing means to said means for pivoting said fin means, said connecting means including means for reversing the direction of movement of said fin means by said fin pivoting means, said reversing means including means for sensing propeller wash pressure and operating in response to changes in propeller wash pressure.

18. A marine propulsion device for use with a marine vehicle, said device comprising a propulsion unit pivotable about a first steering axis to steer the vehicle, fin means mounted on said propulsion unit and pivotable about a second steering axis for assisting in steering the vehicle, hydraulic sensing means for sensing torque on said propulsion unit relative to said first steering axis so as to facilitate pivoting of said fin means in response to said torque, means for pivoting said fin means about said second steering axis, and means operable connecting said hydraulic sensing means to said means for pivoting said fin means, said connecting means including means for reversing the direction of movement of said fin means by said fin pivoting means, said reversing means comprising valve means, and means for operating said valve means.

19. A marine propulsion device in accordance with claim 18 wherein said valve means comprises a valve housing including an elongated cylindrical chamber, a first inlet port, a second inlet port spaced apart from said first inlet port, a first outlet port spaced outside of said first and second inlet ports and adjacent said first inlet port, a second outlet port spaced outside of said first and second inlet ports and adjacent said second inlet port, and a third outlet port spaced between said first and second inlet ports, means defining two movable smaller chambers in said elongated cylindrical chamber and comprising first, second, and third aligned, spaced apart solid cylindrical portions, a first smaller diameter connecting rod connecting said first portion to said second portion, and a second smaller diameter connecting rod connecting said second portion to said third portion, said means defining two movable smaller chambers being movable between a first position wherein said first inlet port is in communication with said third outlet port and said second inlet port is in communication with said second outlet port, and a second position wherein said first inlet port is in communication with said first outlet port and said second inlet port is in communication with said third outlet port.

20. A marine propulsion device for use with a marine vehicle, said device comprising a plurality of propulsion units respectively pivotable about first parallel steering axes to steer the vehicle, fin means respectively mounted on said propulsion units and respectively pivotable about parallel second steering axes for assisting in steering the vehicle, and means for hydraulically sensing operator applied torque on the propulsion units relative to said first steering axes and for pivoting said fin means in response to torque sensing of said operator applied torque and for hydraulically sensing hydrodynamically applied torque on said propulsion units relative to said first steering axes and for pivoting said fin means in response to torque sensing of said hydrodynamically applied torque immediately upon initial steering movement of said propulsion unit.

21. A marine propulsion device for use with a boat, said marine propulsion device comprising a propulsion unit pivotal about a first steering axis to steer the boat, fin means mounted on said propulsion unit for pivotal movement about a second steering axis so as to assist in steering the boat, operator actuated means connected to said propulsion unit for steering said propulsion unit, a hydraulic assembly including a cylinder and a piston located in said cylinder and dividing said cylinder into opposite pressure chambers which are subject to pressure variation in response to relative movement between said piston and said cylinder, one of said cylinder and said piston being connected to one of said propulsion unit and said steering means for displacing said piston and cylinder relative to each other in selective response to each of operator applied steering force and hydro-dynamically applied steering force, whereby pressure is varied in said chambers in immediate response to initial steering movement of said propulsion unit in response to hydro-dynamically applied torque, and means connected to said chambers for displacing said fin means in response to pressure variation in said chambers.

* * * * *